US007648295B2

(12) United States Patent
Fredell

(10) Patent No.: US 7,648,295 B2
(45) Date of Patent: Jan. 19, 2010

(54) SHOE SHINE PEN

(76) Inventor: Lisa Fredell, 257 Page St. West, St. Paul, MN (US) 55107

( * ) Notice: Subject to any disclaimer, the term of this patent is extended or adjusted under 35 U.S.C. 154(b) by 0 days.

(21) Appl. No.: 11/681,086

(22) Filed: Mar. 1, 2007

(65) Prior Publication Data

US 2007/0253760 A1 Nov. 1, 2007

Related U.S. Application Data

(60) Provisional application No. 60/777,926, filed on Mar. 1, 2006.

(51) Int. Cl.
*B05C 1/00* (2006.01)
*A47L 1/08* (2006.01)

(52) U.S. Cl. ..... 401/25; 401/17; 401/18

(58) Field of Classification Search ..... 401/16, 401/17, 18, 23, 198, 25
See application file for complete search history.

(56) References Cited

U.S. PATENT DOCUMENTS 4,077,725 A * 3/1978 Slautterback ..... 401/17
6,805,512 B2 * 10/2004 King ..... 401/270

* cited by examiner

*Primary Examiner*—David J Walczak
(74) *Attorney, Agent, or Firm*—Briggs and Morgan, P.A.

(57) ABSTRACT

A handheld cleaning device, particularly for footwear cleaning, including first and second opposed ends, with each end having access to a reservoir containing either a cleaning solution or a shoe polishing compound. A method of using the device to clean and polish footwear is also described.

13 Claims, 8 Drawing Sheets

SHOE SHINE PEN

RELATED APPLICATIONS

This applications claims the benefit of priority pursuant to 35 USC §119 of prior Application Ser. No. 60/777,926 filed Mar. 1, 2006, incorporated by reference herein.

BRIEF SUMMARY OF THE INVENTION

The present invention is directed to a hand-held applicator including a first reservoir and a second reservoir, wherein the second reservoir is located at the opposite end of the applicator from the first reservoir. Each reservoir houses at least a portion of a fluid conducting fiber. A portion of each fluid conducting fiber extends through an aperture in the applicator. The first reservoir may contain a cleaning solution, while the second reservoir may contain a shoe polishing compound.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawing, in which.

DETAILED DESCRIPTION OF THE INVENTION

Figure 1:
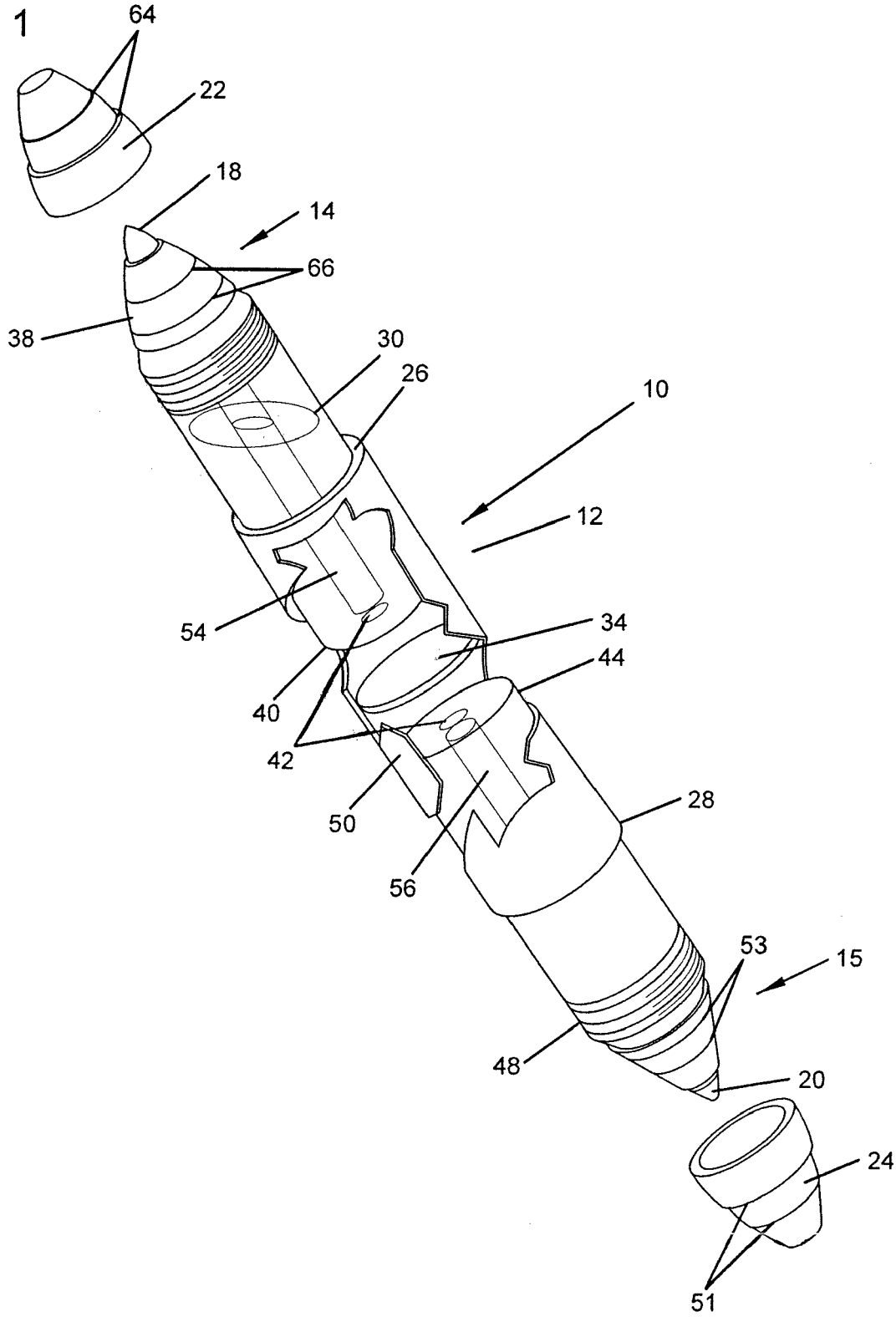
FIG. 1 is a partial cutaway view illustrating a cleaning instrument according to one embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As shown in FIG. 1, in one embodiment of the present invention the cleaning solution applicator is sized to be hand-held. The applicator is comprised of a main tubular body 12 having a first end 14 and a second end 15. The first end 14 includes an exposed applicator tip 18 and removable cover 22. The second end 15 also includes an exposed applicator tip 20 and removable cover 24. The tubular body 12 has a first receptacle 26 at the first end of the body and a second receptacle 28 at the second end of the body. The first receptacle 26 receives a module 30. The module 30 is comprised of a tubular body having a first end 38 and a second end 40. The second receptacle 28 receives a second module 44. The second module is also comprised of a tubular body having a first end 48 and second end 50. The first module acts as a fluid reservoir and houses a first fluid conducting fiber 54 with a portion exposed through an aperture in the first end 38 of the module. The second module is also a fluid reservoir and houses a second fluid conducting fiber 56 with a portion exposed through an aperture in the first end 48 of the module. The portions of the first and second conducting fibers extending beyond the modules function as the applicator tips 18, 20. The modules 30, 44 can be removed from the main body of the instrument for refilling or replacement. For example, the first module 30 can be retained in the first receptacle 26 of the main body of the instrument 12 by means of screw-threads or a snap-fit bead structure. The second module 44 also can be retained by the second receptacle 28 by means of screw-threads or a snap-fit bead structure. When inserted into the main instrument body 12 the modules are separated by a gasket 34. The gasket 34 seals the first module 30 and second module 44, preventing fluid from leaking from either module.

In one embodiment, the instrument caps 22, 24 can be axially aligned and secured to the first 14 and second end 15 of the instrument, respectively. The first cap 22 has a retaining portion 64 of a shape to receive the locking portion 66 of the first end of the instrument. The second cap 24 also has a retaining portion 51 of a shape to receive the locking portion 53 of the second end of the instrument. The caps can be removably affixed to prevent unwanted leakage or application of fluid.

According to one embodiment of the present invention, the first module 30 contains a cleaning solution and the second module 44 contains a polishing solution, such as MELATONIAN shoe wax. Modules 30 and 44 are of the same total fluid volume and occupy the same volume of space within the instrument. In a separate embodiment, the modules can have different total volumes and occupy different volumes of space within the main body of the instrument.

The fluid conducting fiber 54 and tip 18 contained in the first module 30, in one embodiment, is comprised of a material suitable for transporting a cleaning solution from the reservoir of the module to the exposed applicator tip. The fluid conducting material is capable of retaining the fluid within the fiber and preventing unwanted discharge of fluid from the tip. The exposed tip 18 applies the solution to a surface upon contact with the surface. The tip 18 can have a flat, angular or blunt conical shape suitable for repeated application of the solution to a shoe. Similarly, the fluid conducting fiber 56 and tip 20 contained in the second module 44 is comprised of a material suitable for transporting a shoe polish solution from the reservoir of the module to the exposed applicator tip. The fluid conducting material of the second module is also capable of retaining the shoe polish solution at the applicator tip 20. The tip 20 can have a flat, angular or blunt conical shape suitable for repeated application of the shoe polish solution upon contact with the shoe surface.

Figure 2:
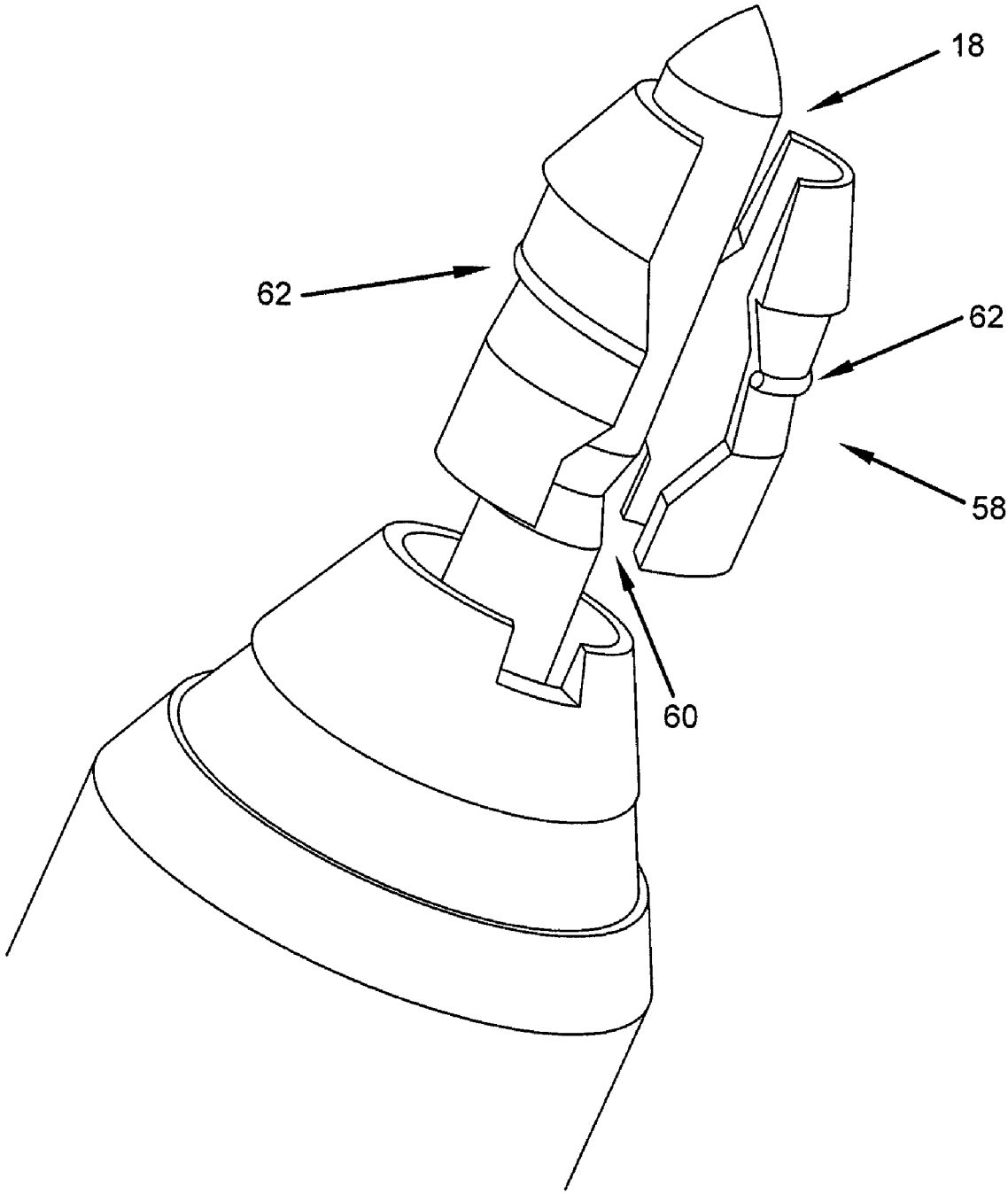
FIG. 2 is a perspective view of one embodiment of the tip portion of the present invention in FIG. 1 in a disassembled state.

As shown in FIG. 2, one embodiment of the present invention includes a mechanism for securing both fluid conducting fibers 54, 56 within in its respective module. The mechanism is comprised of a tip retaining structure, generally identified as 58. The retaining structure consists of a mainly tubular shaped body, split in half, with openings at both the first and second end. The first end of the tip retaining structure 58 is around a notch 60 in the fluid conducting fiber via a fastener 62. The tip retaining structure can be axially aligned and secured to the first end of a fluid filled module such that the retaining portion 62 engages and locks into the module, thus securing the fluid conducting fiber within the module. The tip retaining structure seals tightly around the fluid conducting fiber to prevent leakage of fluid from the module.

Figure 3:
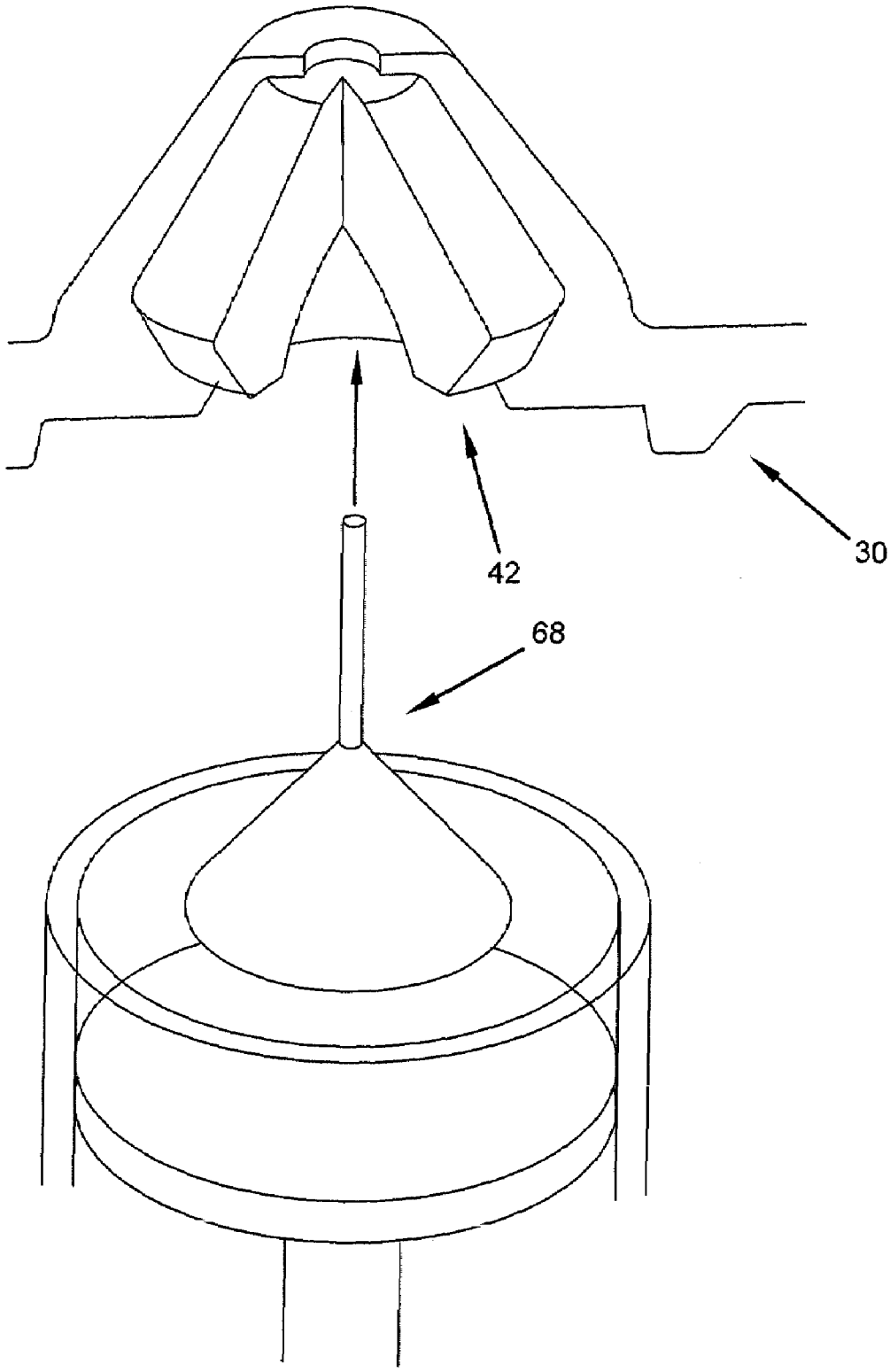
FIG. 3 is a partial cutaway view of one embodiment of a module refilling mechanism for the present invention.

As shown in FIG. 3, in one embodiment of the module refilling method the instrument modules have a refilling port 42. The refilling port is comprised of a self-sealing material that can be perforated by a syringe needle 68. Upon insertion of the syringe needle into the port, replacement fluid can be injected into the module. The self-sealing material comprising the injection port is capable of receiving multiple perforations while still maintaining a leak-proof seal.

Figure 4:
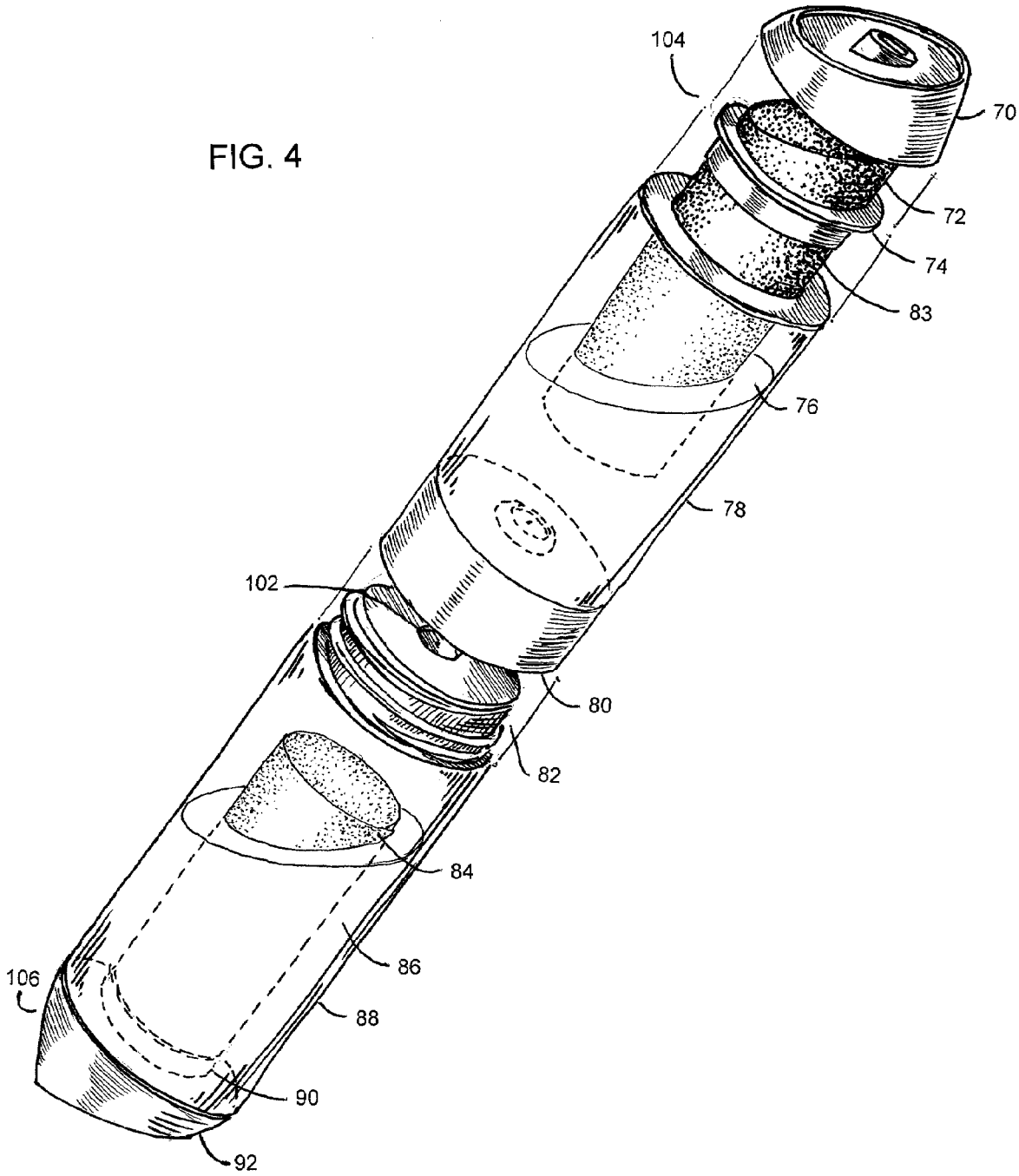
FIG. 4 is a partial cutaway view illustrating a second embodiment of the present invention.

FIG. 4 shows another embodiment of the present invention. The applicator is comprised of a first module 78 and second module 88. The first module consists of a tubular body having a first end 104 and second end 80. The second end of the first module has an outer circular ridge which extends beyond the sealed end of the module. The interior portion of the circular ridge is threaded. The second module also consists of a tubular body having a first end 106 and second end 82. The second end of the second module is threaded. The thread patterns of the second ends of the first and second modules 80, 82 are constructed so that the first module can receive the second module. Using the screw-type threads, the modules can be interlocked together. The first end of the first module includes an exposed applicator tip 72 and removable cover 70. The first module acts as a fluid reservoir and houses a fluid 76 and a fluid conducting substance 83 with a portion of the substance exposed through an aperture in the first end, which serves as the applicator tip. The first end of the second module also includes an exposed applicator tip 85, as shown in FIG. 5*b*, and removable cover 92. The second module also acts as a fluid reservoir and houses a fluid conducting substance 84 where a portion of the substance exposed through an aperture in the second end serves as the applicator tip. The first and second modules both contain a refilling port 102 located at the second end of each module. The refilling port is comprised of a self-sealing substance capable of being punctured without leaking.

Figure 5A:
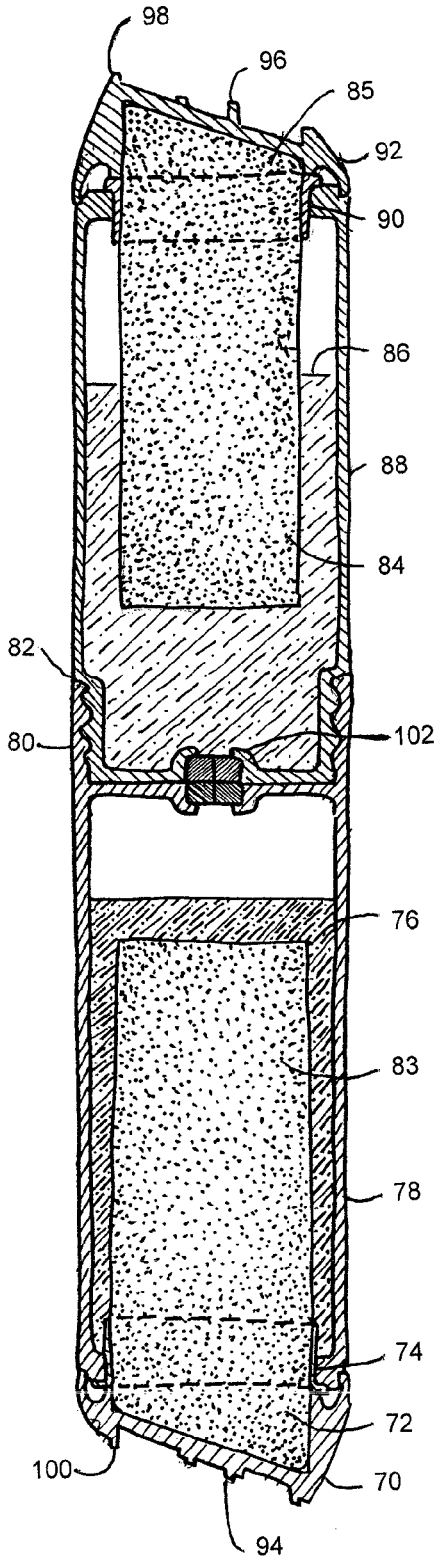
FIG. 5*a* is a cross-sectional side view of a second embodiment of the invention.
Figure 5B:
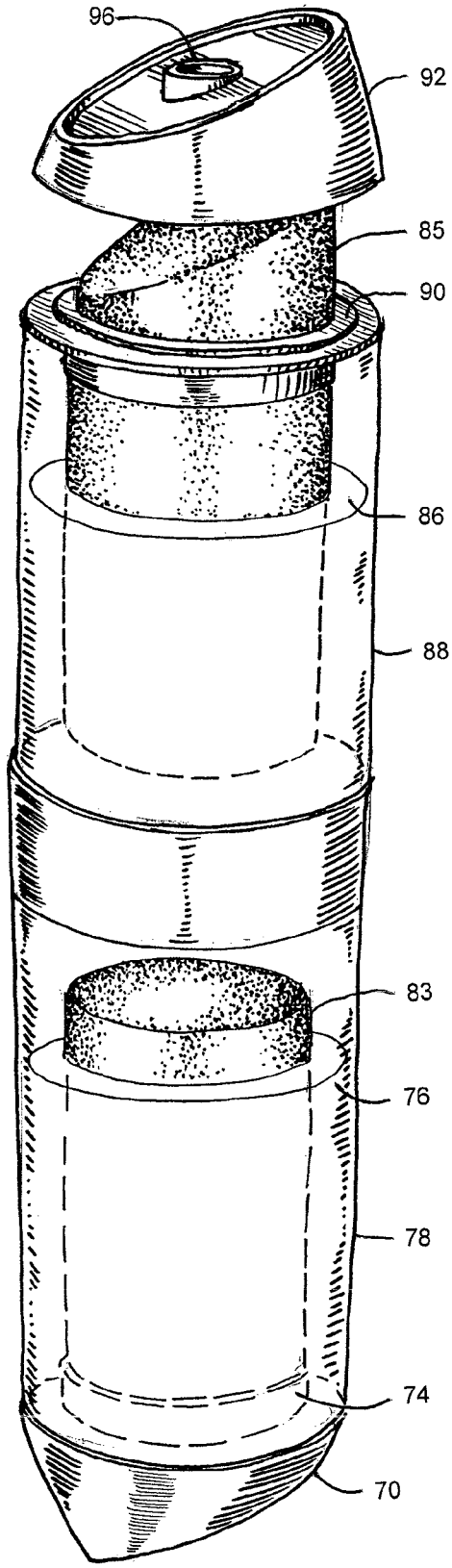
FIG. 5*b* is a perspective view of the embodiment shown in FIG. 5*a*.
Figure 6A:
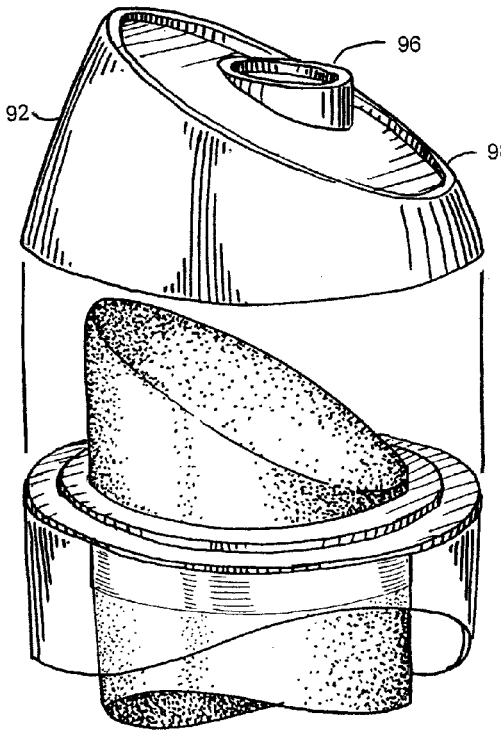
FIG. 6*a* is a perspective view of the cap portion of a second embodiment of the present invention.
Figure 6C:
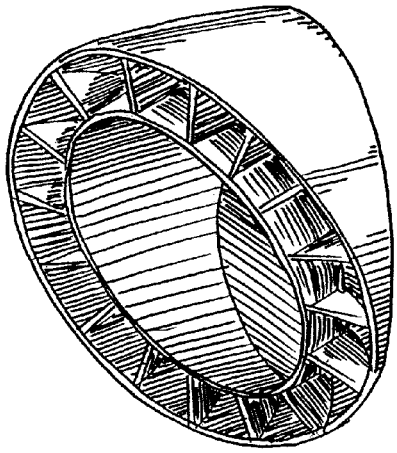
FIG. 6*c* is a perspective view of the cap shown in FIG. 6*a*.
Figure 6E:
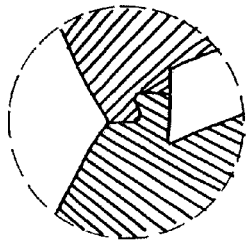
FIG. 6*e* is an expanded view of the circled portion of FIG. 6*d*.
Figure 6B:
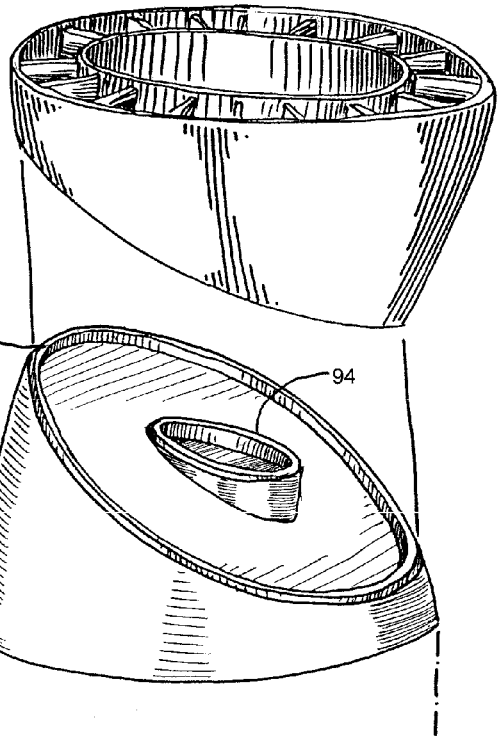
FIG. 6*b* is a perspective view of two caps of the embodiment shown in FIG. 6*a*.
Figure 6D:
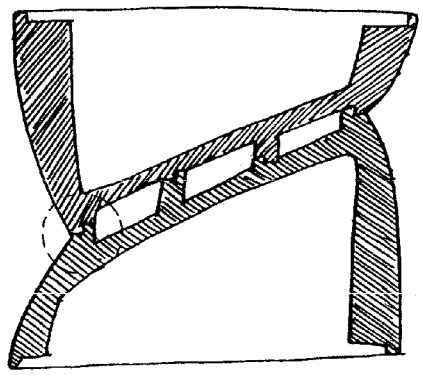
FIG. 6*d* is a cross-sectional side view of the caps shown in FIG. 6*b* locked together.

As shown in FIG. 4 and FIG. 5, in the second embodiment of the present invention the fluid conducting fiber 83 is retained within the first module via a snug fitting collar 74. The inner diameter of the collar is the same as or sufficiently close to the diameter of the fluid conducting fiber so that it tightly grips the fiber when the fiber is inserted into the collar. An aperture in first end of the module receives the collar, subsequently retaining the fluid conducting fiber in the reservoir portion of the module. In the same manner, the fluid conducing fiber 84 is retained within the second module via a snug fitting collar 90.

The second embodiment shows the applicator tips of the instrument both having a slant, angular-cut shape. This particular shape maximizes the usable surface area of the tips which facilitates greater contact with the shoe. In another embodiment, the tips can have different shapes such as flat or conical. Also, although both tips of the instrument are shown having the same shape, in a separate embodiment the tips can have different shapes.

FIG. 6 shows another embodiment of the removable cap. In this embodiment, the removable caps 70, 92 can be removably attached together. The caps can be interlocked by axially aligning the caps and facing the distal end of the first cap 70 towards the distal end of the second cap 92. The outer rim of the distal end of the second cap contains a snap-fit bead 98 which receives the snap-fit structure 100 on the outer rim of the distal end of first cap 70. The distal end of the first cap also contains a second snap-fit bead structure 94 located in the center of the cap. A corresponding snap-fit structure 96 is located on the distal end of the second cap. When the caps are aligned axially and pressed together, the snap-fit retention structures securely bind the caps together.

Figure 7:
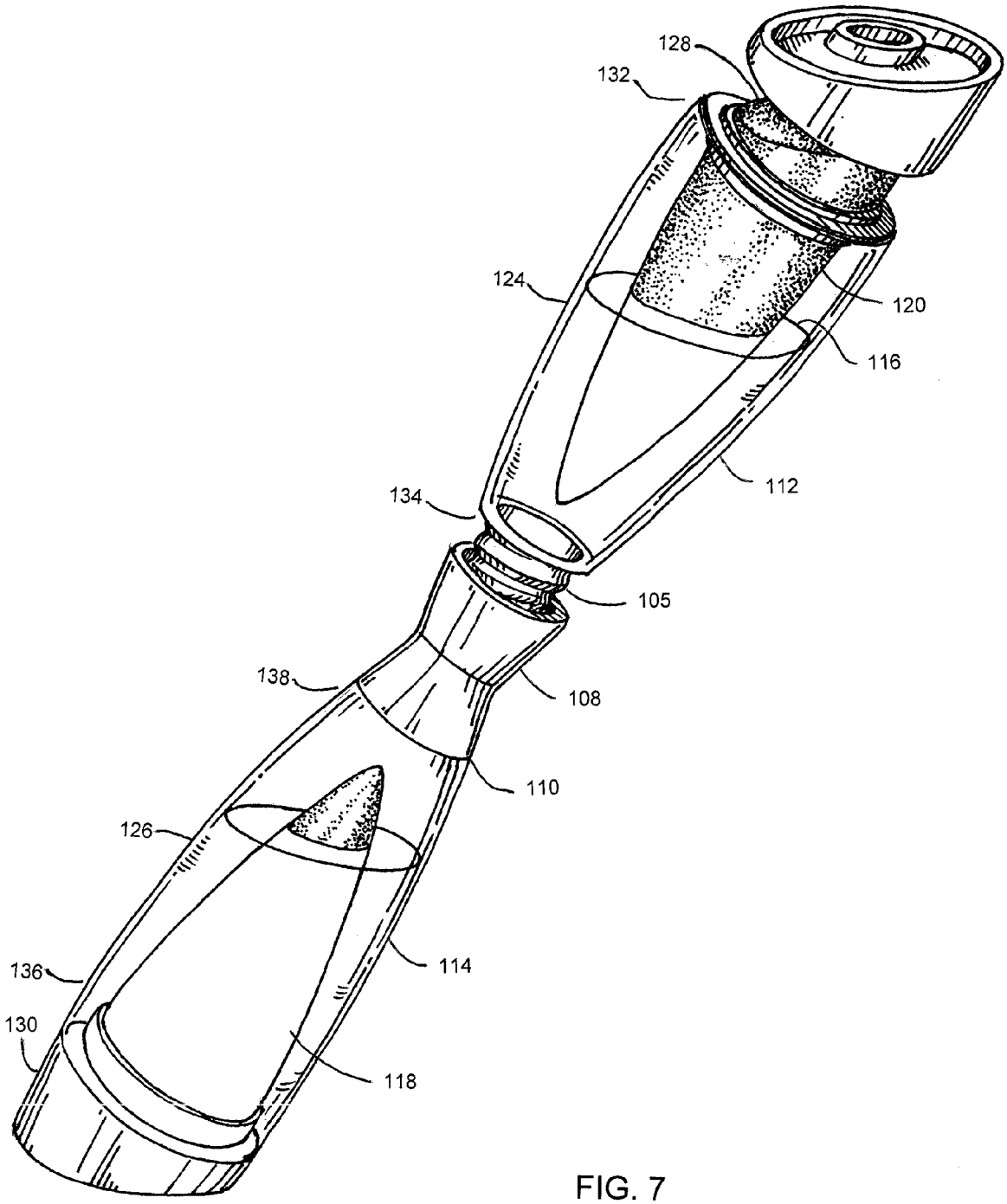
FIG. 7 is a partial cutaway view illustrating a cleaning instrument according to a third embodiment of the present invention.
Figure 8A:
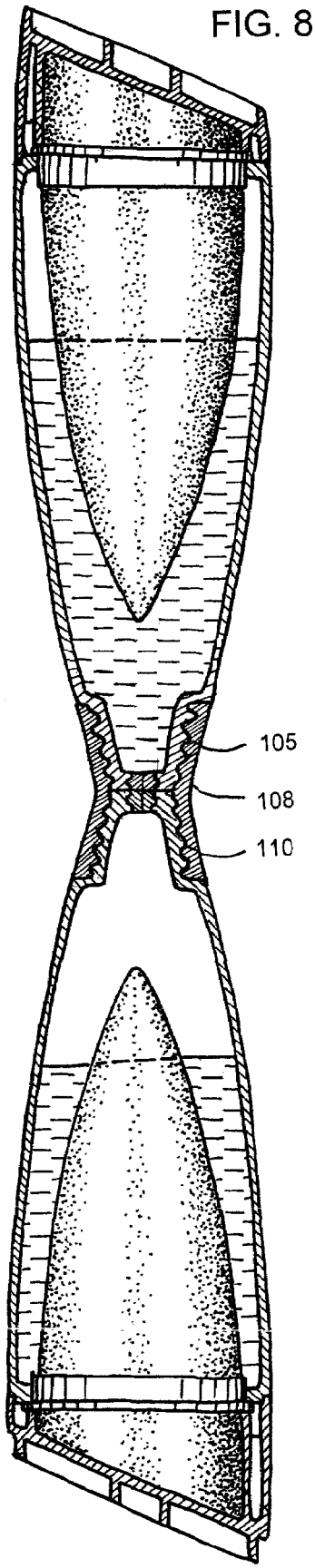
FIG. 8*a* is a cross-sectional side view of a third embodiment of the present invention.

A third embodiment of the invention, as shown in FIG. 7, has an ergonomic shape. The instrument is comprised of a first module 112 and second module 114. The first module consists of a tapered tubular body having a first end 132 and second end 134. The second end of the first module has a threaded end 105. Similarly, the second module consists of a tapered tubular body having a first end 136 and second end 138 where the second module has a threaded end 110 as shown in FIG. 8*a*. A small coupler 108 is threaded at both ends and receives the modules.

The first module acts as a fluid reservoir 124 for fluid 116 and houses a fluid conducting substance 120 with a portion of the substance exposed through an aperture in the first end, which serves as the applicator tip 128. The exposed applicator tip is protected by a removable cover. The first end of the second module also includes an exposed applicator tip and removable cover 130. The second module also acts as a fluid reservoir 126 and houses a fluid conducting substance 118 where a portion of the substance exposed through an aperture in the second end serves as the applicator tip. The fluid conducting substance generally has the same conical shape as its respective module. In a separate embodiment, the fluid conducting substance can have a shape different than that of its respective module.

Figure 8B:
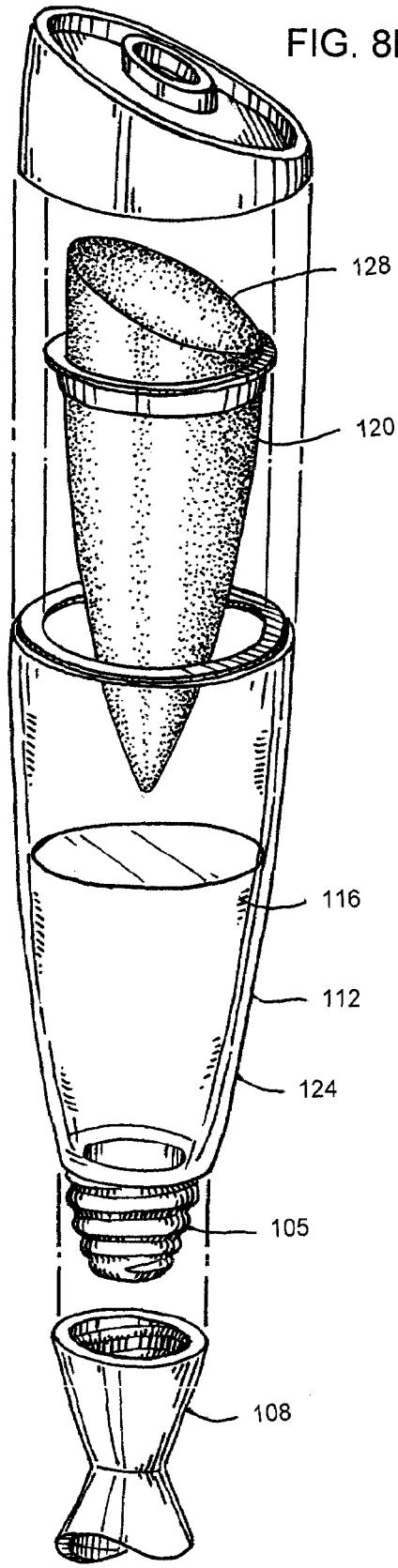
FIG. 8*b* is a perspective view of a portion of the embodiment shown in FIG. 8*a*.

As shown in FIG. 8, in one embodiment of the invention the shape of the assembled instrument is generally that of an hourglass.

Thus, while the present invention has been fully described above with particularity and detail in connection with what is presently deemed to be the most practical and preferred embodiment(s) of the invention, it will be apparent to those of ordinary skill in the are that numerous modifications, including, but not limited to, variations in size, materials, shape, form, function and manner of operation, assembly and use may be made, without departing from the principles and concepts of the invention set forth in the description.

I claim:

1. A hand-held applicator comprising:

a first reservoir containing a cleaning solution, wherein the first reservoir houses at least a portion of a first fluid conducting fiber;

a second reservoir containing a shoe polishing compound, wherein the second reservoir houses at least a portion of a second fluid conducting fiber;

a first aperture at a first end of the applicator, wherein the first fluid conducting fiber extends through the first aperture; and a second aperture at a second end of the applicator, wherein the second fluid conducting fiber extends through the second aperture, wherein said applicator is generally elongated and said first and second reservoirs are at opposite ends of the applicator.

2. The hand-held applicator of claim 1, wherein the second reservoir comprises an injection port comprised of a self-sealing material.

3. The hand-held applicator of claim 1, wherein the first reservoir and the second reservoir are separated by a gasket.

4. The hand-held applicator of claim 1, wherein the first reservoir comprises an injection port comprised of a self-sealing material.

5. A hand-held applicator comprising:

a tubular body comprising a first reservoir and a second reservoir, wherein the first reservoir contains a cleaning solution and the second reservoir contains a shoe polishing compound;

a first fluid conducting fiber, wherein at least a portion of the first fluid conducting fiber is located within the first reservoir;

a second fluid conducting fiber, wherein at least a portion of the second fluid conducting fiber is located within the second reservoir;

a first aperture at a first end of the tubular body, wherein the first fluid conducting fiber extends through the first aperture; and a second aperture at a second end of the tubular body, wherein the second fluid conducting fiber extends through the second aperture.

6. The hand-held applicator of claim 5, wherein the second reservoir comprises an injection port comprised of a self-sealing material.

7. The hand-held applicator of claim 5, wherein the first reservoir and the second reservoir are separated by a gasket.

8. The hand-held applicator of claim 5, wherein the first reservoir and the second reservoir are retained in the tubular body by screw-threads.

9. The hand-held applicator of claim 5, wherein the first reservoir and the second reservoir are retained in the tubular body by a snap-fit bead structure.

10. The hand-held applicator of claim 5, wherein the first reservoir and the second reservoir occupy different volumes of space within the tubular body.

11. The hand-held applicator of claim 5, wherein the first reservoir and the second reservoir occupy equal volumes of space within the tubular body.

12. The hand-held applicator of claim 5, wherein the first reservoir comprises an injection port comprised of a self-sealing material.

13. The hand-held applicator of claim 5, wherein the shape of the tubular body is generally that of an hourglass.

* * * * *